US009884485B2

(12) United States Patent
Yoshikawa et al.

(10) Patent No.: US 9,884,485 B2
(45) Date of Patent: Feb. 6, 2018

(54) LIQUID EJECTING HEAD AND LIQUID EJECTING APPARATUS

(71) Applicant: CANON KABUSHIKI KAISHA, Tokyo (JP)

(72) Inventors: Shimpei Yoshikawa, Yokohama (JP); Chiaki Muraoka, Kawaguchi (JP); Tokuji Kudo, Kawasaki (JP); Hiromasa Amma, Kawasaki (JP); Takuya Iwano, Inagi (JP); Kimiyuki Hayasaki, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/154,326

(22) Filed: May 13, 2016

(65) Prior Publication Data

US 2016/0339699 A1 Nov. 24, 2016

(30) Foreign Application Priority Data

May 22, 2015 (JP) ..... 2015-104524

(51) Int. Cl.
*B41J 2/14* (2006.01)
*B41J 2/05* (2006.01)
*B41J 2/175* (2006.01)

(52) U.S. Cl.
CPC ..... *B41J 2/1752* (2013.01); *B41J 2/1753* (2013.01); *B41J 2/17546* (2013.01); *B41J 2002/14491* (2013.01)

(58) Field of Classification Search
CPC ..... B41J 2002/14491; B41J 2/04581; B41J 2/14233; B41J 2/04541; B41J 2/1433
(Continued)

(56) References Cited

U.S. PATENT DOCUMENTS 5,675,366 A 10/1997 Hayasaki et al.
6,749,287 B2 6/2004 Osada et al.
(Continued)

FOREIGN PATENT DOCUMENTS

JP 2002-079655 A 3/2002

OTHER PUBLICATIONS

U.S. Appl. No. 15/154,222, Shimpei, Yoshikawa, Chiaki Muraoka, Tokuji Kudo, Hiromasa Amma, Takuya Iwano, Kimiyuki Hayasaki, May 13, 2016.

*Primary Examiner* — Jannelle M Lebron
(74) *Attorney, Agent, or Firm* — Fitzpatrick, Cella, Harper & Scinto

(57) ABSTRACT

A liquid ejecting head and a liquid ejecting apparatus are designed so as to suppress the influence of noise on control signals. The liquid ejecting head has a plurality of terminals electrically connected with a contact point provided in the liquid ejecting apparatus, and a liquid ejecting element substrate having a liquid ejecting element formed for ejecting liquid in response to the control signals transmitted from the liquid ejecting apparatus. A power source terminal for drive and a ground terminal for drive, which are provided for driving the liquid ejecting element, are arranged adjacent to each other, and a power source wiring that connects the power source terminal for drive with the liquid ejecting element substrate and a ground wiring that connects the ground terminal for drive with the liquid ejecting element substrate are at least partially arranged in parallel.

14 Claims, 8 Drawing Sheets

(58) Field of Classification Search
USPC ..... 347/9, 50, 58
See application file for complete search history.

(56) References Cited

U.S. PATENT DOCUMENTS

| | | | | |
|---|---|---|---|---|
| 7,607,758 | B2 | 10/2009 | Hatasa et al. | |
| 9,156,263 | B2 | 10/2015 | Kodoi et al. | |
| 9,238,361 | B2 | 1/2016 | Muraoka et al. | |
| 2008/0129791 | A1* | 6/2008 | Furukawa ..... | B41J 2/04541 347/58 |

* cited by examiner

LIQUID EJECTING HEAD AND LIQUID EJECTING APPARATUS

BACKGROUND OF THE INVENTION

Field of the Invention

The present invention relates to a liquid ejecting head and a liquid ejecting apparatus.

Description of the Related Art

In a liquid ejecting head, there is known a configuration in which a plurality of terminals for being electrically connected with a contact point of a liquid ejecting apparatus main body is provided. As a countermeasure against noise in a case where the plurality of terminals and a liquid ejecting element substrate of the liquid ejecting head are connected with wirings and control signals from the main body are transmitted to the liquid ejecting element substrate, a configuration or the like of making an area of a conductor pattern serving as a wiring as large as possible is disclosed in Japanese Patent Laid-Open No. 2002-079655.

Recently, the number of liquid ejecting elements that are provided in a liquid ejecting head tends to be increased for high-speed processing, or print of a high-resolution image. In a case where the number of liquid ejecting elements is increased, an amount of the current flowing through a wiring for drive for driving the liquid ejecting element is also increased. The increase in the amount of the current also causes the increase in the influence of noise on the control signal for the liquid ejecting element, and an intended liquid ejecting action may not be executed by the influence of noise.

Since the area of a region where a conductor pattern can be formed is limited, there is a fear that, even when the area of a conductor pattern is made as large as possible as described in Japanese Patent Laid-Open No. 2002-079655, the above-described noise cannot be suppressed.

SUMMARY OF THE INVENTION

The present invention has been achieved in consideration of the above-described problem, and an object thereof is to provide a liquid ejecting head and a liquid ejecting apparatus which can suppress the influence of noise on a control signal.

According to a first aspect of the present invention, there is provided a liquid ejecting head comprising: a plurality of terminals for being electrically connected with a contact point provided in a liquid ejecting apparatus; and a liquid ejecting element substrate having a liquid ejecting element formed for ejecting a liquid in response to a control signal transmitted from the liquid ejecting apparatus, wherein the plurality of terminals includes a power source terminal for drive and a ground terminal for drive, for driving the liquid ejecting element; the power source terminal for drive and the ground terminal for drive are arranged adjacent to each other; and a power source wiring that connects the power source terminal for drive with the liquid ejecting element substrate, and a ground wiring that connects the ground terminal for drive with the liquid ejecting element substrate are at least partially arranged in parallel.

According to a second aspect of the present invention, there is provided a liquid ejecting apparatus mounting a liquid ejecting head, the liquid ejecting head comprising a plurality of terminals for being electrically connected with a contact point provided in the liquid ejecting apparatus, and a liquid ejecting element substrate having a liquid ejecting element formed for ejecting a liquid in response to a control signal transmitted from the liquid ejecting apparatus, wherein the plurality of terminals includes a power source terminal for drive and a ground terminal for drive, for driving the liquid ejecting element; the power source terminal for drive and the ground terminal for drive are arranged adjacent to each other; and a power source wiring that connects the power source terminal for drive with the liquid ejecting element substrate, and a ground wiring that connects the ground terminal for drive with the liquid ejecting element substrate are at least partially arranged in parallel.

Further features of the present invention will become apparent from the following description of exemplary embodiments (with reference to the attached drawings).

DESCRIPTION OF THE EMBODIMENTS

Hereinafter, embodiments of the present invention will be described in detail with reference to the drawings.

Figure 1:
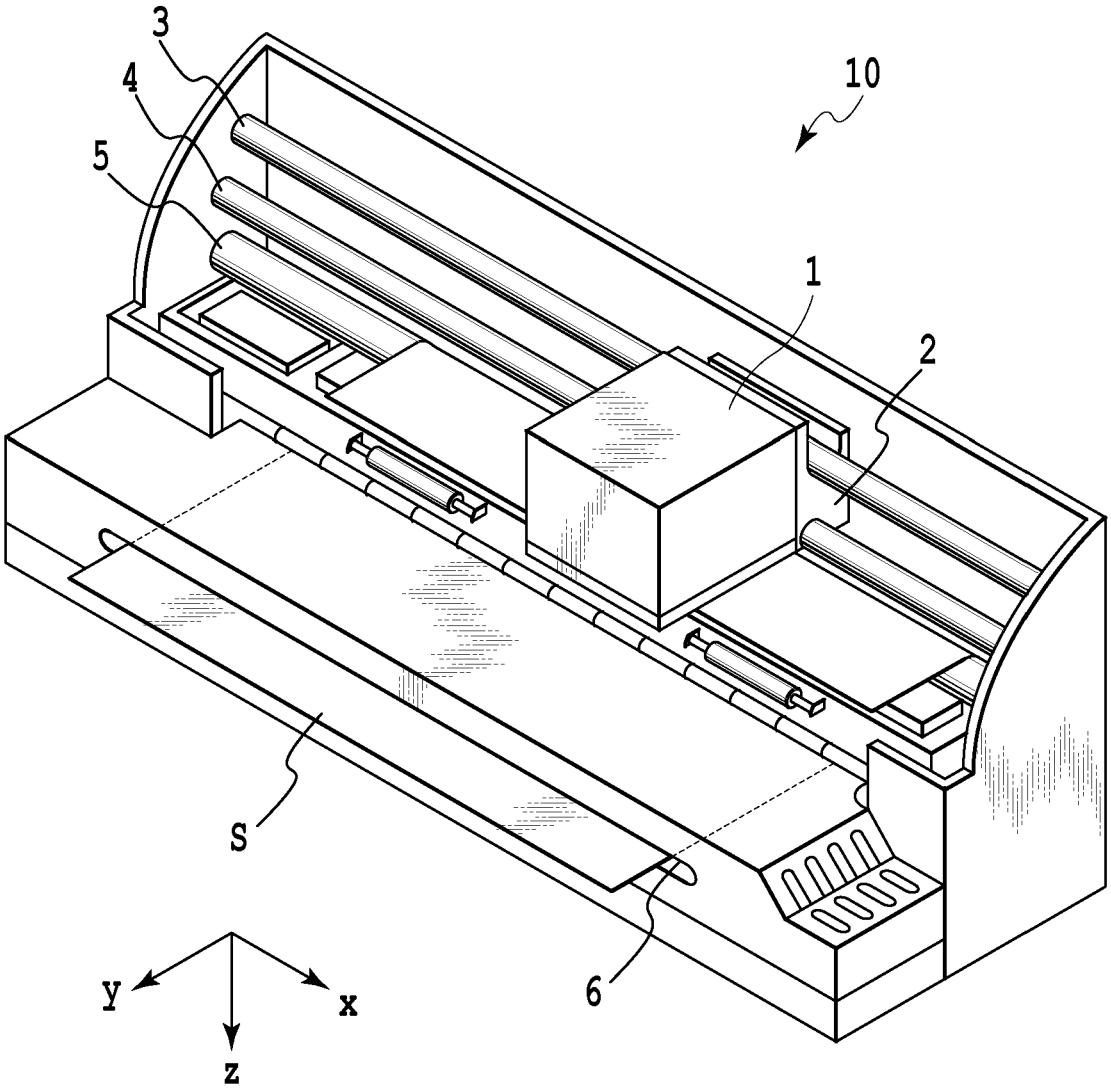
FIG. 1 is a schematic perspective view showing an internal configuration of a liquid ejecting apparatus using a liquid ejecting head.

FIG. 1 is a schematic perspective view showing an internal configuration of a liquid ejecting apparatus (hereinafter, referred to as a "print apparatus") 10 using a liquid ejecting head (hereinafter, referred to as a "print head") 1. The print apparatus 10 is an ink-jet print apparatus of a serial scan system. In the print head 1, an ejection port (not shown) is formed on a surface facing a sheet S. The liquid is given to the sheet S by ejecting a liquid from the ejection port downward in the z direction shown in the drawing. Note that, here, a case where ink is ejected from the ejection port will be explained. The print head 1 is mounted on a carriage 2. The carriage 2 is reciprocatingly guided in the x direction by using guide shafts 3 and 4 extending in the main scanning direction (the x direction shown in the drawing).

The sheet S inverts, after being inserted into the print apparatus 10 from an insertion port 6 provided in the print apparatus 10, the traveling direction thereof, and then, is conveyed in a sub-scanning direction (the y direction shown in the drawing) by a roller 5. In the print apparatus 10, an image is printed on the sheet S by repeating a print operation of ejecting ink from the print head 1 along with the movement of the carriage 2, and a conveyance operation of the sheet S by the roller 5.

Here, the print head 1 is assumed to utilize, as energy for ejecting ink, heat energy that is generated from an electrothermal converter (heater) being a print element. In this case, the ink is caused to generate film boiling by heat generation of the heater, and the ink is ejected from the ejection port by a foaming energy at that time. Note that a piezoelectric element or the like may be used as the print element.

Figure 2:
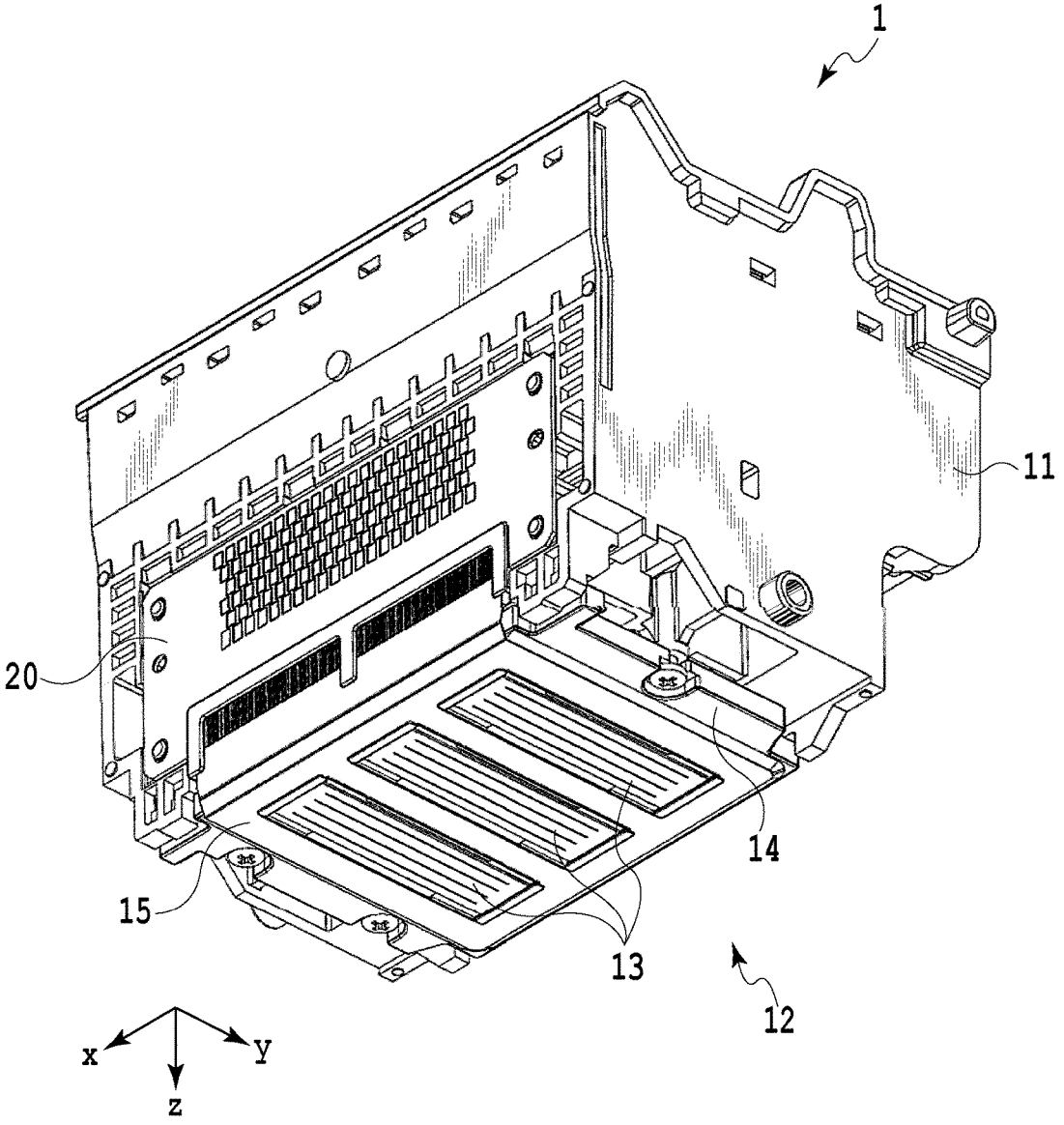
FIG. 2 is a perspective view showing the liquid ejecting head.

FIG. 2 is a perspective view showing the print head 1. As shown in the drawing, the print head 1 includes a housing 11, a contact substrate 20, a wiring member 15, and a print element substrate unit 12. The contact substrate 20, the wiring member 15, and the print element substrate unit 12 are fixed to the housing 11. An ink tank (not shown) storing ink is mounted on the housing 11, and a flow path for supplying ink to the print element substrate unit 12 from the ink tank is provided inside the housing 11.

The print element substrate unit 12 includes a print element substrate (liquid ejecting element substrate) 13. The print element substrate 13 is an Si substrate, and an opening serving as an ink flow path is formed on the print element substrate 13, by anisotropic etching. Furthermore, the print element substrate 13 is provided with a plurality of heaters as a print element. The print element substrate 13 is provided with a plurality of ink flow paths and a plurality of ejection ports formed by photolithography using a resin material. The ink in the ink tank passes through the flow path and goes toward the ejection port, by communicating the flow path of the housing 11 and the flow path of the print element substrate 13. Note that four openings each serving as the ink flow path are formed on one print element substrate 13, and inks of different colors can be ejected from ejection port rows of four rows in one print element substrate 13.

The print element substrate unit 12 has a support member 14 made from an alumina material, and the print element substrate 13 is supported by the support member 14. Note that, in FIG. 2, there is shown the case where three print element substrates 13 are used, but the number of usable print element substrates is not limited to three. Furthermore, in FIG. 2, there is shown the case where ejection port rows of four rows are formed for one print element substrate 13, but the row number of ejection port rows is also not limited to four.

The wiring member 15 electrically connects an electrode portion of the print element substrate 13 with a terminal in the contact substrate 20. Signals from the print apparatus 10 are transmitted to the print element substrate 13 of the print element substrate unit 12 via the contact substrate 20 and the wiring member 15. The wiring member 15 is provided with an opening portion in a position that corresponds to the position where the print element substrate 13 is arranged, and the opening shape of the opening portion is a rectangle. An electrode portion to be electrically connected with the electrode portion of the print element substrate 13 is provided near the short side of the opening portion. Furthermore, the wiring member 15 is provided with a connection portion for connecting electrically with the connection portion of the contact substrate 20. Note that an electric wiring tape or the like can be used as the wiring member 15.

Although details will be described later with reference to FIGS. 4A, 4B, and the like, various types of terminals are provided on the contact substrate 20. In addition, although description will be made later with reference to FIGS. 7A and 7B, the carriage 2 is provided with an electric connection pin 30, in a position that makes contact with the terminal of the contact substrate 20 in the case where the print head 1 is mounted. The electric connection pin 30 is electrically connected to a control circuit on the print apparatus 10 side. In the case where the terminal of the contact substrate 20 and the electric connection pin 30 are contact-connected to each other, the contact substrate 20 and a control circuit (not shown) on the print apparatus 10 side are electrically connected to each other, and electric power is supplied to the print element substrate 13 from the print apparatus 10 side via the contact substrate 20 and signals are transmitted. Ejection of ink is controlled on the basis of the signal transmitted from the control circuit of the print apparatus 10, and an image is printed on the sheet S.

Figure 3:
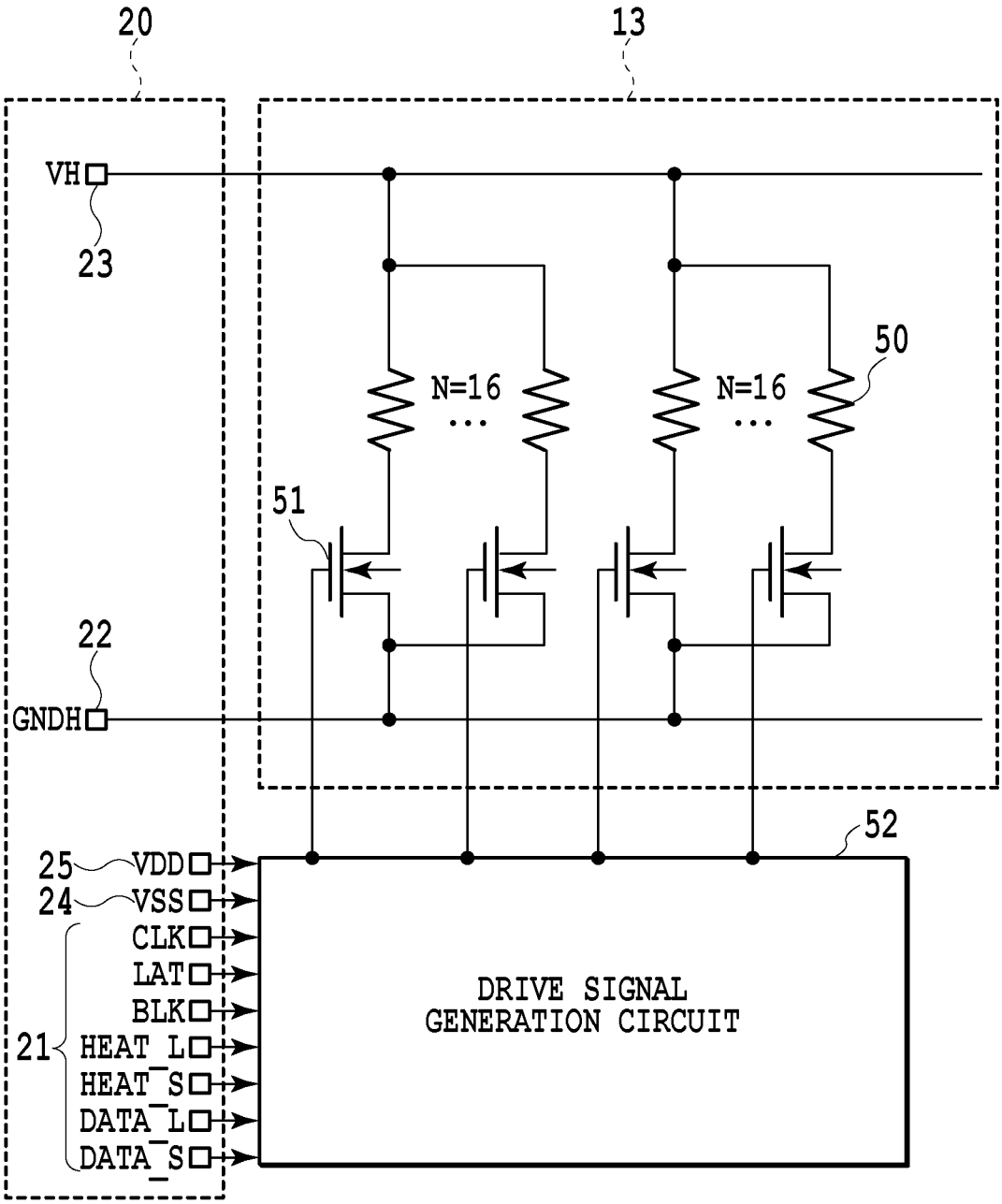
FIG. 3 is a circuit diagram showing a drive circuit of the liquid ejecting head.

FIG. 3 is a circuit diagram showing a drive circuit of the print head 1. The print element substrate 13 is provided with a heater 50, a drive element 51 and a drive signal generation circuit 52. The drive signal generation circuit 52 has a shift register circuit (not shown), a latch circuit (not shown), a decode circuit (not shown) and the like, and generates drive signals for the drive element on the basis of the signal from a control circuit of the print apparatus 10. In a case where the drive element 51 is turned ON according to the generated drive signal, a voltage is applied to the heater 50.

As shown in FIG. 3, a VH wiring and a GNDH wiring are separately wired for each block in the print element substrate 13, but each thereof is formed into one wiring in the contact substrate 20. According to this wiring, an electric current flowing through the VH wiring and the GNDH wiring in the contact substrate 20 increases along with the increase in number of print elements. In this case, noise enters control signals (data signals) transmitted by the DATA wiring, and an intended print operation may not be executed. Accordingly, here, terminals and wirings are arranged so as to suppress the influence of noise on data signals. Details will be described later with reference to FIGS. 5A to 5D and FIGS. 6A to 6D.

Figure 4A:
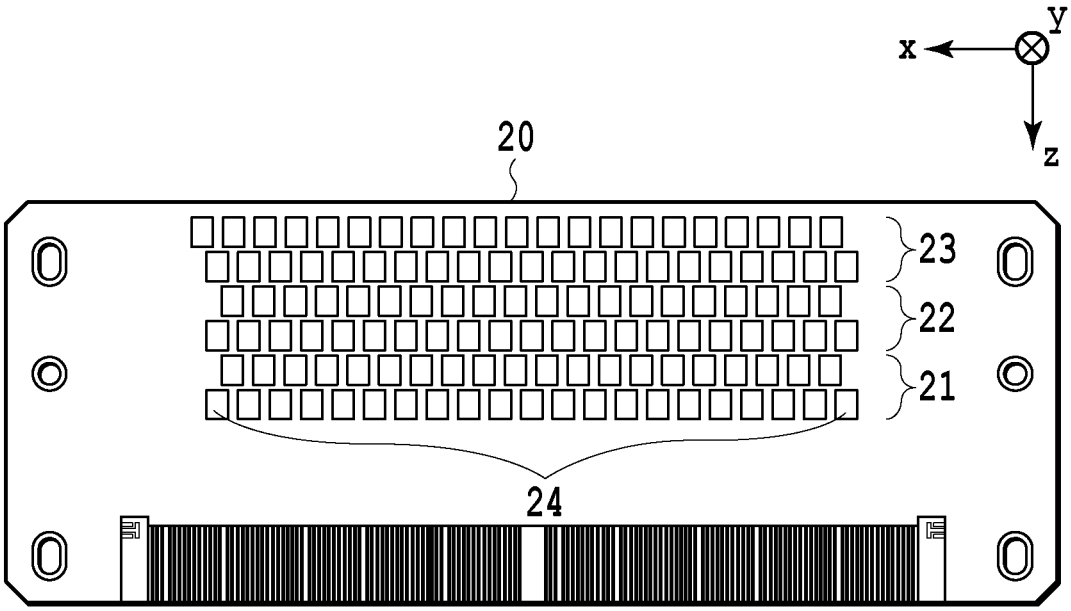
FIGS. 4A and 4B are schematic views each showing a contact substrate.
Figure 4B:
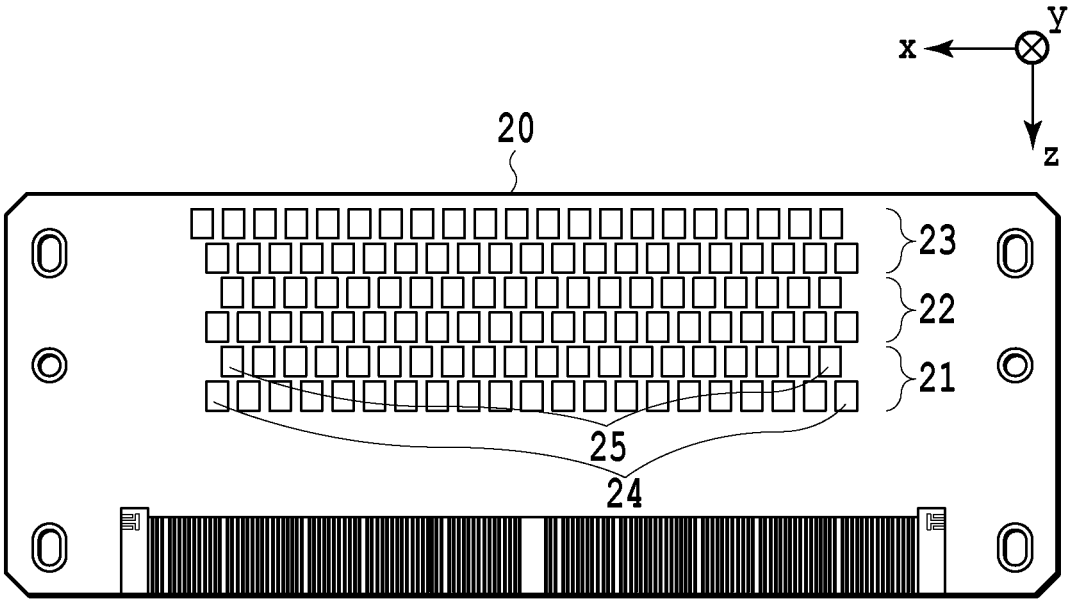

FIGS. 4A and 4B are schematic views showing a surface on which terminals of the contact substrate 20 are provided. As shown in FIGS. 4A and 4B, the contact substrate 20 is provided with a plurality of terminals 21 to 23, and has six rows of terminals that are constituted of a plurality of the terminals arranged along the x direction. The contact substrate 20 shown in FIGS. 4A and 4B is provided with one hundred and twenty-four terminals. The terminals include a print element (heater) power source terminal (VH) 23, a heater ground terminal (GNDH) 22, a data signal terminal (DATA) 21, a logic power source terminal (VDD) 25, and a ground terminal (VSS) 24. The VH (power source terminal for drive) 23 is a drive power source of the heater. The GNDH (ground terminal for drive) 22 is a ground of the heater. The DATA (signal terminal) 21 is a terminal that transfers serial data for independently turning ON/OFF respective heaters. The VDD (power source terminal for control) 25 is a power source for a logic signal, and the VSS (ground terminal for control) 24 is a ground for a logic signal. Namely, the VH 23 and the GNDH 22 are terminals for driving elements to drive the heater, and the DATA 21, the VDD 25 and the VSS 24 are terminals for controlling elements to control the heater. Here, a voltage of 32 V is assumed to be applied to the VH 23 and the GNDH 22, and a voltage of 3.3 V is assumed to be applied to the VDD 25 and the VSS 24.

As shown in FIGS. 4A and 4B, terminal rows of two rows including a plurality of DATAs 21, terminal rows of two rows including a plurality of GNDHs 22, and terminal rows of two rows including a plurality of VHs 23 are arranged in this order of positions closer to the wiring member 15 (the print element substrate 13). Furthermore, as shown in FIGS. 4A and 4B, in the terminal row at the lowermost part in the z direction among the terminal rows of the DATA 21, the VSS 24 is arranged on both sides in the arrangement direction of the terminals (x direction). Moreover, in FIG. 4B, the VDD 25 is arranged on both sides in the x direction of the terminal row of the second terminal row from the bottom in the z direction among the terminal rows of the DATA 21.

Here, with reference to FIG. 3 again, a flow of drive of the print element by signals that are input from a terminal will be explained. In the configuration shown in FIG. 3, there is used a time division drive system in which print elements are sequentially driven for each block while setting sixteen print elements as one block. CLK shown in FIG. 3 is a terminal that transfers clock signals for synchronizing the transfer of serial data that is input to the DATA 21. LAT is a terminal that transfers a latch signal serving as a trigger for shifting the serial data to a holding circuit in a print element substrate. BLK is a terminal that transfers a block selection signal for selecting a block to be driven. HEAT is a terminal that transfers a pulse signal for controlling VH application time with respect to a print element by pulse length.

The serial data that has been input via the DATA 21 are transferred to a shift register circuit (not shown) in the print element substrate 13 in synchronization with the clock signal. A data group input to the shift register circuit is held in a latch circuit (not shown) by the input of the latch signal, and a pulse-shaped drive signal is generated by subjecting the held data, the pulse signal and the block selection signal to AND processing. The drive element 51 is turned ON/OFF by the drive signal, and thus the drive of the heater 50 (print element) is turned ON/OFF.

Figure 5A:
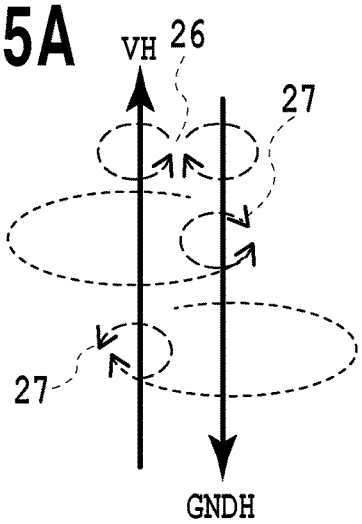
FIGS. 5A to 5D are schematic views for explaining the influence of noise.
Figure 5B:
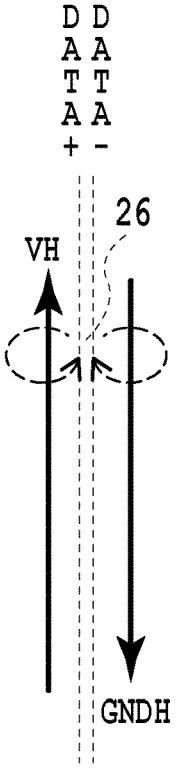
Figure 5C:
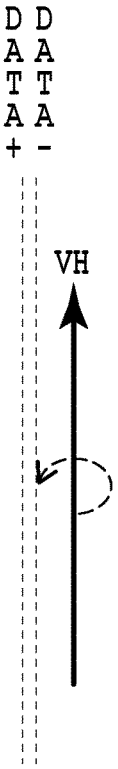
Figure 5D:
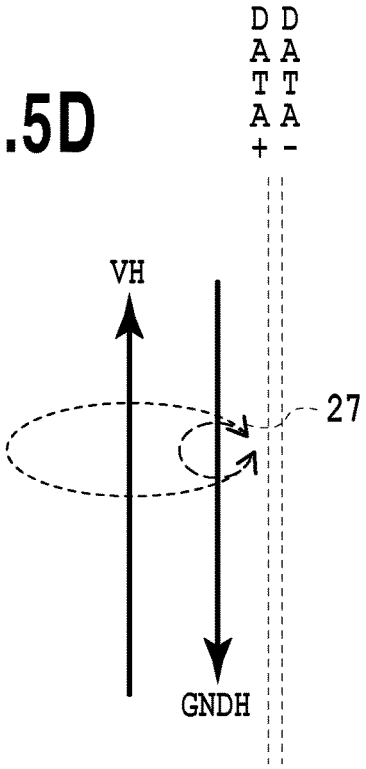

FIGS. 5A to 5D are schematic views for explaining the influence of noise. As shown in FIGS. 5A, 5B and 5D, in the VH wiring (power source wiring) and the GNDH wiring (ground wiring), flows of the signal are opposite to each other. Intensity of a magnetic field is proportional to the magnitude of an electric current and inversely proportional to distance. As shown in FIG. 5A, in the case where the VH wiring and the GNDH wiring are in parallel, magnetic fields generated from both are intensified in a region 26 between the VH wiring and the GNDH wiring, and are weakened in a region 27 not between the VH wiring and the GNDH wiring.

FIGS. 5B to 5D are drawings for explaining the influence of noise in a low voltage differential signal transmission system (LVDS). The shown VH wiring, GNDH wiring and LVDS wiring (DATA+ and DATA− (DATA wiring (signal wiring)) shown in the drawing) are wirings connected to an identical print element substrate. In the transmission system, signals in anti-phase each other are sent at the same time by using two signal wires, and the signals sent are combined on a reception side. Accordingly, when the same noise is superimposed on two signals, the noise is cancelled in the combination.

However, when noises are superimposed in different ways, they are not cancelled in the combination, and have an influence on the transfer of data. For example, as shown in FIG. 5B, when the LVDS wiring is arranged between the VH wiring and the GNDH wiring, noises of anti-phase are superimposed on two signals that are transmitted by the LVDS wiring. Since these noises are superimposed in different ways respectively, they are not cancelled at the time of the combination and intended data transmission cannot be performed. Furthermore, as shown in FIG. 5C, when a single VH wiring and the LVDS wiring are in parallel, noises of in-phase are superimposed on two signals. However, since the distance from the VH wiring to the DATA+ wiring and the distance from the VH wiring to the DATA− wiring are different from each other, influences of the magnetic field from the VH wiring are different, and intensities of noises that are superimposed on two signals are different from each other. Accordingly, noise remains in the combined data signal. The phenomenon is generated even in the case where a single GNDH wiring and the LVDS wiring are arranged in parallel.

As shown in FIG. 5D in contrast to the configuration shown in FIGS. 5B and 5C, in the case where the VH wiring and the GNDH wiring are in parallel and the LVDS wiring is arranged outside the region between these wirings, the LVDS wiring can be arranged in a region where magnetic fields cancel each other. Accordingly, the influence of noise on data signals can be suppressed. The effect of reducing noise on data signals can further be enhanced by setting the distance between the VH wiring and the GNDH wiring to be comparatively small and arranging the DATA wiring in a position comparatively apart from the position in which these wirings are arranged. Details will be explained with reference to FIGS. 6A to 6D, and here, the VH 23 and the GNDH 22 are arranged adjacent to each other, and thus the VH wiring and the GNDH wiring are arranged in parallel and the DATA wiring is arranged in a position not between these wirings.

FIGS. 6A to 6D are schematic views showing a layout of terminals and wirings. Also in FIGS. 6A to 6D, in the same way as in FIGS. 4A and 4B, a terminal row of the DATA 21, a terminal row of the GNDH 22 and a terminal row of the VH 23 are arranged in order of positions closer to the print element substrate 13. In FIGS. 6A to 6D, there are shown cases where one print element substrate 13 is provided with three terminal rows, each of which is constituted of three terminals. In each configuration, the VH 23 and the GNDH 22 are arranged adjacent to each other.

Figure 6A:
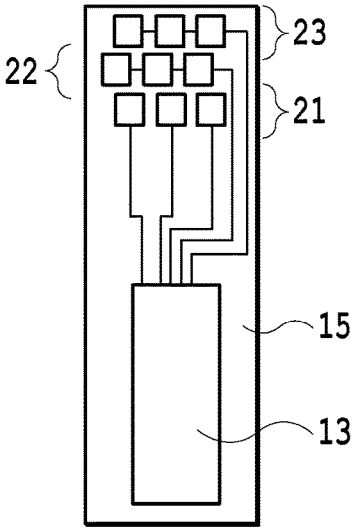
FIGS. 6A to 6D are schematic views each showing a layout of terminals and wirings.
Figure 6B:
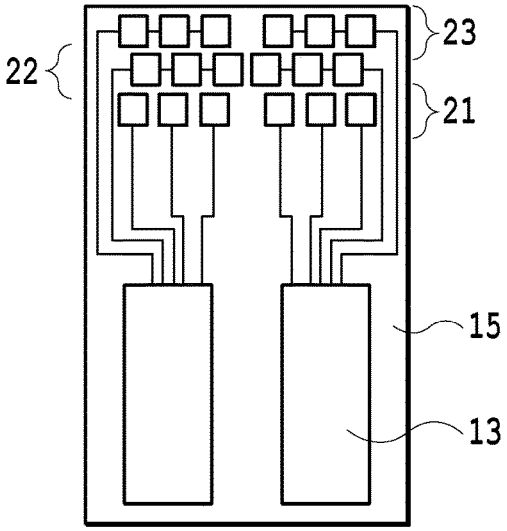

Note that it is not indispensable to provide terminals on the contact substrate 20 as shown in FIGS. 2, 4A, and 4B, but terminals may be patterned on the wiring member 15. In FIGS. 6A and 6B, the case where terminals and wirings are patterned on the wiring member 15 is shown. In FIG. 6A, one print element substrate 13 is shown. In FIG. 6B, two print element substrates 13 are shown. In both configurations shown in FIGS. 6A and 6B, the VH 23 and the GNDH 22 to be connected to the same print element substrate 13 are arranged adjacent to each other, and thus a VH wiring and a GNDH wiring to be connected to the same print element substrate 13 can be arranged in parallel. Since currents of the same amount flow through the VH wiring and the GNDH wiring to be connected to the same print element substrate 13 in directions different from each other, there can be adopted a configuration in which each other's magnetic fields are cancelled in a region that is not sandwiched by these wirings. The influence of noise on data signals can be suppressed by arranging the DATA wiring in the region.

Figure 6C:
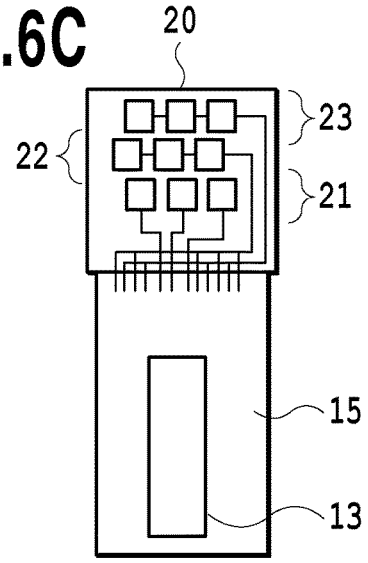
Figure 6D:
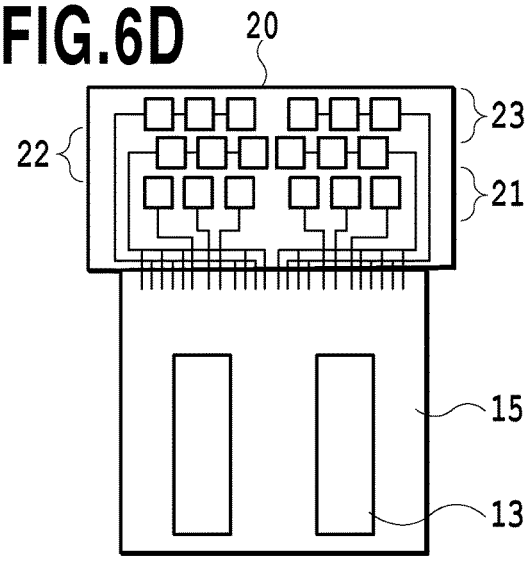

In FIGS. 6C and 6D, as explained in FIG. 3, there is shown a configuration in which a wiring in common (common wiring) is used in the contact substrate 20 and a branched wiring is used in the print element substrate 13. In the case of the wiring, as described above, as the number of print elements increases, a current flowing through the VH wiring and the GNDH wiring increases, in particular, in the common wiring portion. Accordingly, here, the VH wiring and the GNDH wiring are arranged in parallel and the DATA wiring is arranged in a position that is not sandwiched by these, at least in the common wiring portion. Since the common wiring portion is a portion having a small distance from a terminal, the VH wiring and the GNDH wiring can be arranged in parallel without adopting a complicated configuration, by arranging the VH terminal and the GNDH terminal adjacent to each other. Note that there can also be considered a configuration in which the DATA wiring is arranged in a position orthogonal to the position where the VH wiring and the GNDH wiring are arranged in parallel, but in this case, the influence by noise becomes restrictive and the influence on data signals is also small. Also in FIG. 6C in the same way as in FIG. 6A, one print element substrate 13 is shown. Also in FIG. 6D, in the same way as in FIG. 6B, two print element substrates 13 are shown. In configurations shown in FIGS. 6C and 6D, in the common wiring portion, the VH wiring and the GNDH wiring corresponding to each other in the same print element substrate 13 are arranged in parallel and the DATA wiring is arranged in a region not sandwiched by these, and thus the influence of noise on data signals can be suppressed.

As described above, here, the VH 23 and the GNDH 22 are arranged adjacent to each other, and thus the VH wiring and the GNDH wiring are at least partially arranged in parallel, and the DATA wiring is arranged in a position that is not a position not between these wirings. Accordingly, the influence of noise on data signals can be suppressed, and a transmission performance of data signals to the print element substrate 13 from the print apparatus 10 side can be ensured. Namely, here, the influence of noise on data signals can be suppressed by the arrangement of wirings, instead of the area of a wiring. Furthermore, since the DATA 21 is arranged in a position closest to the print element substrate 13, the length of the DATA wiring gives the shortest distance among possible configurations that may be considered and parallel distance from another wiring also becomes short, with the result that the influence of noise on data signals can be suppressed.

Note that the VH wiring and the GNDH wiring can be arranged in parallel even in the case where the VH 23 and the GNDH 22 are arranged not adjacent to each other, but there are some cases or the like where it becomes necessary to relatively increase a routing distance of either one of or both of wirings. Accordingly, the configuration in which the VH 23 and the GNDH 22 are arranged adjacent to each other in the same way as in the present embodiment can enhance the effect of reducing noise as compared with other configurations.

Figure 7A:
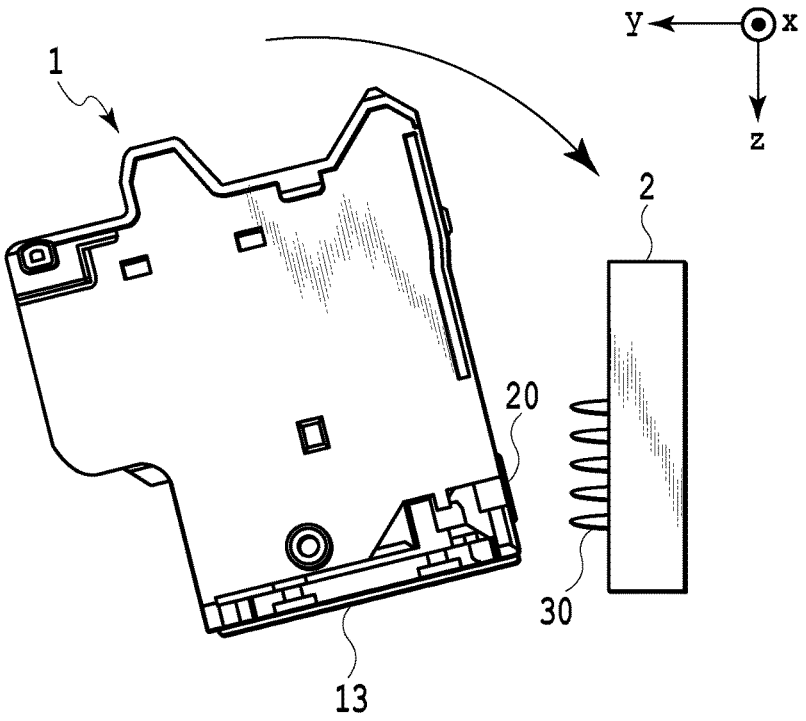
FIGS. 7A and 7B are drawings each showing amounting method of the liquid ejecting head.
Figure 7B:
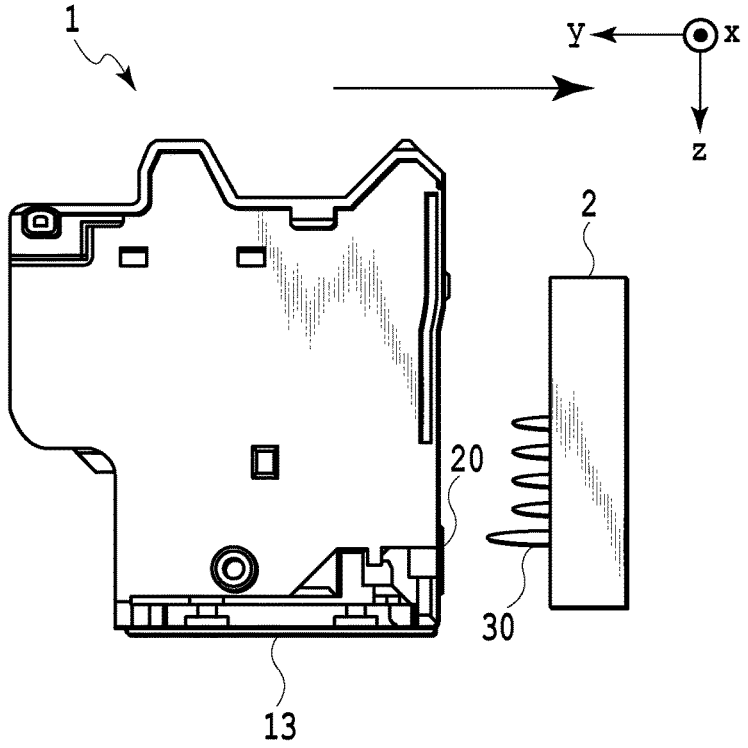

FIGS. 7A and 7B are drawings for explaining a mounting method of the print head 1 onto the carriage 2. FIG. 7A shows the case where a rotational mounting is performed, and FIG. 7B shows the case where a slide mounting is performed. As shown in FIGS. 7A and 7B, the electric connection pin 30 that is provided on the carriage 2 and the contact substrate 20 of the print head 1 are faced each other, and the print head 1 is mounted onto the carriage 2.

In the case where the rotational mounting shown in FIG. 7A is performed, the lower end portion in the z direction in the surface of the print head 1 facing the electric connection pin 30 is brought close to the electric connection pin 30, and the print head 1 is rotated in the clockwise direction when the drawing is viewed from the front while utilizing the end portion as a supporting point. In the case where the slide mounting shown in FIG. 7B is performed, an electric connection pin corresponding to a terminal required to be connected earlier than other terminals is projected toward the y direction more than other electric connection pins, and thus the terminal is first connected to the electric connection pin. Note that, here, an electric connection pin to be connected with the VSS 24 has a length that is equal to or longer than the length of an electric connection pin to be connected with the DATA 21. Here, in any method, the terminal arranged at the lowest part in the z direction is first connected with the electric connection pin 30, but the mounting method may be changed depending on a terminal arranged in which position is to be first connected.

When the mounting method explained referring to FIGS. 7A and 7B is to be adopted in the arrangement of terminals explained referring to FIGS. 4A and 4B, the VSS 24 is first connected to the electric connection pin 30 and, at the same time or subsequently, the DATA 21 is connected to the electric connection pin 30. Accordingly, latch-up generated in the case or the like where the VSS 24 is connected after the DATA 21 is connected to the electric connection pin 30 can be prevented. In this way, here, latch-up can be prevented by adopting a mounting method in which the VSS 24 is first connected to the electric connection pin 30, or the DATA 21 and the VSS 24 are simultaneously connected to the electric connection pin 30.

Note that, in both configurations shown in FIGS. 4A and 4B, the VSS 24 is arranged at both ends of the terminal row at the lowermost part in the z direction. In the case where the print head 1 is mounted on the carriage 2 by arranging the VSS 24 in this way, even if the print head 1 makes partial contact with the carriage 2, the electric connection pin 30 can be first connected to either of the VSSs 24 at both ends, or can be simultaneously connected to the DATA 21 and the VSS 24.

FIG. 4B shows a configuration in which the VDD 25 is arranged at both ends in the x direction of a terminal row in a position close to the print element substrate 13 next to the terminal row at the lowermost part in the z direction. In the case of the configuration, when performing rotational mounting as shown in FIG. 7A, the VSS 24 is first connected to the electric connection pin 30, subsequently, the VDD 25 is connected to the electric connection pin 30, and the GNDH 22 and the VH 23 are connected after being brought into a state where a logic voltage is applied to the DATA 21. As described above, here, the VSS 24 and the VDD 25 can be connected to the electric connection pin 30 prior to the VH 23 and the GNDH 22. Note that the arrangement of the VDD 25 is not limited to the position shown in FIG. 4B, but the VDD 25 may be arranged in any position, only if it is a position that is connected to the electric connection pin 30 after the VSS 24.

As described above, here, there can be prevented the generation of latch-up caused by the connection of a contact point for a control signal system to an electric connection pin before the connection of a contact point for a ground system to the electric connection pin.

FIGS. 8A to 8E are schematic views showing other examples of a layout of terminals. In FIGS. 8A to 8E, there is shown the case where three rows of terminal rows each configured of three terminals are arranged. In FIGS. 8A to 8E, illustration of a writing pattern is omitted. Note that, in explanation below, the left, right, top and bottom are assumed to show directions that are seen from the front in a drawing.

Figure 8A:
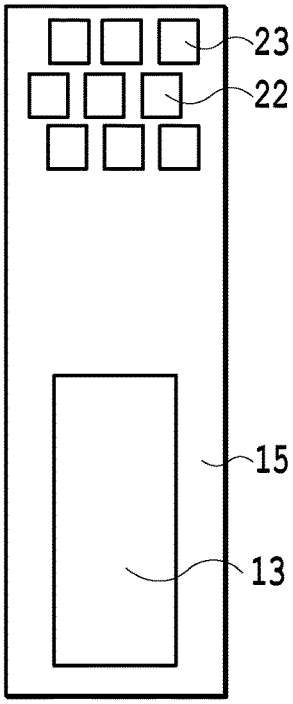
FIGS. 8A to 8E are schematic views each showing other examples of a layout of terminals.

In FIG. 8A, there is shown the case where one VH 23 and one GNDH 22 are arranged. In the case shown in FIG. 8A, respective terminals are arranged at the right end, and are adjacent to one another in a vertical direction. More specifically, the GNDH 22 is arranged at the right end of the terminal row that is second closest to the print element substrate 13, and the VH 23 is arranged at the right end of the terminal row that is farthest from the print element substrate 13, respectively. Also in the arrangement, since the VH 23 and the GNDH 22 are arranged adjacent to each other, the VH wiring and the GNDH wiring can be arranged in parallel to each other. In the case where the VH 23 and the GNDH 22 can be arranged adjacent to each other, the VH wiring and the GNDH wiring can be arranged in parallel to each other, and thus in which direction the VH 23 and the GNDH 22 are adjacent to each other is not particularly limited.

Figure 8B:
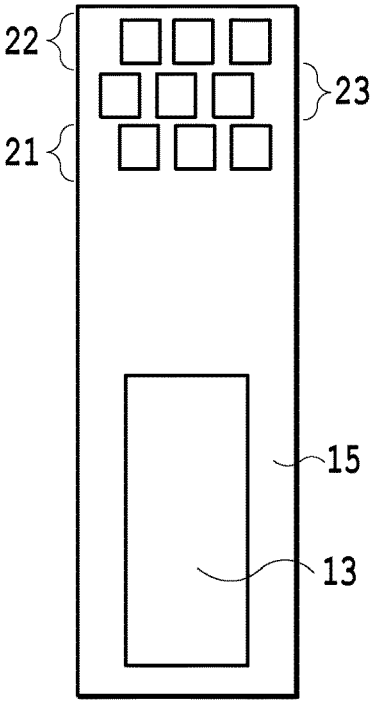
Figure 8C:
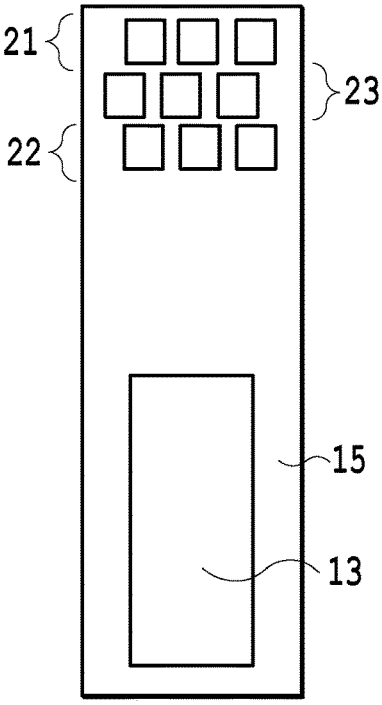

FIG. 8B shows a configuration in which the terminal row of the DATA 21, the terminal row of the VH 23, and the terminal row of the GNDH 22 are arranged in order of positions closer to the print element substrate 13. FIG. 8C shows a configuration in which the terminal row of the GNDH 22, the terminal row of the VH 23, and the terminal row of the DATA 21 are arranged in order of positions closer to the print element substrate 13. As shown in FIGS. 8B and 8C, the VH 23 and the GNDH 22 may be vertically arranged adjacent to each other. However, in the case of the configuration shown in FIG. 8C, the DATA 21 is arranged in a position that is farthest from the print element substrate 13, thereby resulting in a comparatively long DATA wiring. Accordingly, it is preferable to adopt configurations shown in FIGS. 6A to 6D.

Figure 8D:
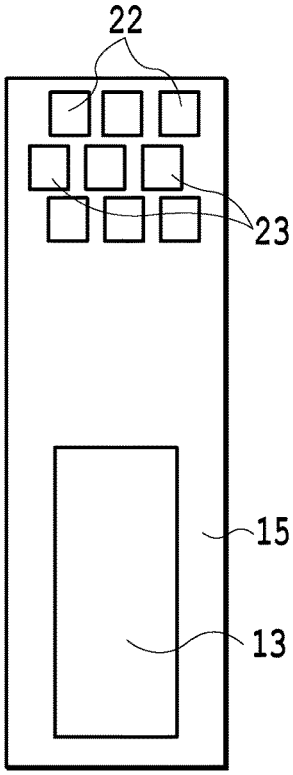
Figure 8E:
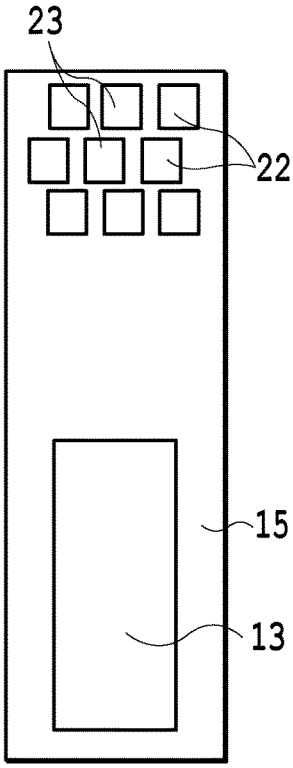

As shown in FIG. 8D, two VHs 23 may also be arranged in a position that is second-closest to the print element substrate 13 so as to sandwich another terminal between the two VHs 23, and GNDHs 22 may also be arranged, respectively, on the upper side of each of these VHs 23. Furthermore, as shown in FIG. 8E, the VH 23 and the GNDH 22 may be arranged adjacent to each other in an identical terminal row.

Other Embodiments

The above-described print head can also be used for: apparatuses such as a copier, a facsimile machine having a communication system and a word processor having a print unit; industrial print apparatuses combined compositely with various types of processing apparatuses; and the like.

In the above-described embodiments, the print head to be used in print apparatuses has been explained as a liquid ejecting head, but the present invention can also be applied to various types of liquid ejecting heads other than the print head. Furthermore, in the embodiments, the case where ink is used as a liquid to be ejected from the liquid ejecting head has been explained, but a liquid such as various processing liquids other than ink may be used as the liquid.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-104524 filed May 22, 2015, which is hereby incorporated by reference herein in its entirety.

What is claimed is:

1. A liquid ejecting head comprising:

a plurality of terminals for being electrically connected with a contact point provided in a liquid ejecting apparatus;

a liquid ejecting element substrate having a liquid ejecting element formed for ejecting a liquid in response to a control signal transmitted from the liquid ejecting apparatus; and a wiring member having a plurality of wirings that connect the plurality of terminals with the liquid ejecting element substrate electrically, wherein the plurality of terminals includes a power source terminal for drive and a ground terminal for drive, for driving the liquid ejecting element;

the power source terminal for drive and the ground terminal for drive are arranged adjacent to each other;

the plurality of wirings includes a power source wiring that connects the power source terminal for drive with the liquid ejecting element substrate and a ground wiring that connects the ground terminal for drive with the liquid ejecting element substrate, and the power source wiring and the ground wiring are at least partially arranged in parallel.

2. The liquid ejecting head according to claim 1, wherein the power source wiring and the ground wiring are arranged in parallel in portions closer to respective terminals than to the liquid ejecting element substrate.

3. The liquid ejecting head according to claim 1, wherein the plurality of terminals includes a signal terminal for controlling the liquid ejecting element and a signal wiring that connects the signal terminal with the liquid ejecting element substrate is arranged outside a region between the power source wiring and the ground wiring.

4. The liquid ejecting head according to claim 1, wherein the liquid ejecting head has a plurality of liquid ejecting element substrates; and the power source wiring and the ground wiring which are arranged in parallel are connected to an identical liquid ejecting element substrate.

5. The liquid ejecting head according to claim 1, wherein the ground terminal for drive is arranged in a position closer to the liquid ejecting element substrate than the power source terminal for drive.

6. The liquid ejecting head according to claim 1, wherein a signal terminal for controlling the liquid ejecting element is arranged in a position closer to the liquid ejecting element substrate than the ground terminal for drive.

7. The liquid ejecting head according to claim 1, wherein the control signal is transmitted from the liquid ejecting apparatus to the liquid ejecting element substrate by a low voltage differential signal transmission system.

8. The liquid ejecting head according to claim 1, wherein the plurality of terminals is provided on the wiring member.

9. The liquid ejecting head according to claim 1, further comprising a contact substrate that is electrically connected with the wiring member, wherein the plurality of terminals is provided on the contact substrate.

10. The liquid ejecting head according to claim 9, wherein a portion in which the power source wiring and the ground wiring are arranged in parallel is provided on the wiring member.

11. A liquid ejecting apparatus mounting a liquid ejecting head, the liquid ejecting head comprising:

a plurality of terminals for being electrically connected with a contact point provided in the liquid ejecting apparatus, a liquid ejecting element substrate having a liquid ejecting element formed for ejecting a liquid in response to a control signal transmitted from the liquid ejecting apparatus, and a wiring member having a plurality of wirings that connect the plurality of terminals with the liquid ejecting element substrate electrically, wherein the plurality of terminals includes a power source terminal for drive and a ground terminal for drive, for driving the liquid ejecting element, the power source terminal for drive and the ground terminal for drive are arranged adjacent to each other, the plurality of wirings includes a power source wiring that connects the power source terminal for drive with the liquid ejecting element substrate and a ground wiring that connects the ground terminal for drive with the liquid ejecting element substrate, and the power source wiring and the ground wiring are at least partially arranged in parallel.

12. The liquid ejecting apparatus according to claim 11, wherein the plurality of terminals is provided on the wiring member.

13. The liquid ejecting apparatus according to claim 11, further comprising a contact substrate that is electrically connected with the wiring member, wherein the plurality of terminals is provided on the contact substrate.

14. The liquid ejecting apparatus according to claim 13, wherein a portion in which the power source wiring and the ground wiring are arranged in parallel is provided on the wiring member.

* * * * *